United States Patent [19]

Fowler

[11] 4,033,489

[45] July 5, 1977

[54] DISPOSABLE CUP HOLDER

[76] Inventor: Gary K. Fowler, 720 10th Ave., Apt. No. 4, Fairbanks, Alaska 99701

[22] Filed: Nov. 7, 1975

[21] Appl. No.: 629,892

[52] U.S. Cl. ..... 224/48 C; 206/216; 211/73; 248/152

[51] Int. Cl.[2] ..... A47G 23/06

[58] Field of Search ..... 224/48 C, 48 R, 45 R; 294/87.2; 229/1.5 H; 206/150, 72; 211/73; 206/380, 382, 383

[56] References Cited

UNITED STATES PATENTS

| | | | |
|---|---|---|---|
| 1,172,667 | 2/1916 | Bunnell | 224/48 C |
| 1,713,758 | 5/1929 | Horwath | 248/152 |
| 2,111,265 | 3/1938 | Heckel | 206/382 |
| 2,512,963 | 6/1950 | Peiker | 224/45 R |
| 2,556,844 | 6/1951 | Istwan | 206/72 |
| 2,670,124 | 2/1954 | Buchmiller et al. | 224/48 C |
| 3,094,259 | 6/1963 | Diehl | 224/48 C |
| 3,142,425 | 7/1964 | Cobb | 294/31.2 |
| 3,565,323 | 2/1971 | Katzenmeyer | 224/45 |
| 3,887,103 | 6/1975 | Spooner | 224/45 R |

*Primary Examiner*—L. J. Paperner
*Assistant Examiner*—Donald W. Underwood
*Attorney, Agent, or Firm*—Strauch, Nolan, Neale, Nies & Kurz

[57] ABSTRACT

A one piece sheet material holder for at least two paper cups of the type used to dispense popcorn and drinks. The sheet material is made of heavy cardboard or plastic having two cup receiving openings spaced apart by a central rib member. The inner peripheries of the openings have inwardly projecting portions to provide minimum engagement with the cups. A portion of the sheet material depends downwardly to provide a central support which serves as a lateral abutment for whichever cup includes the drink to minimize deflection of the platform.

13 Claims, 6 Drawing Figures

DISPOSABLE CUP HOLDER

BACKGROUND OF THE INVENTION

In theaters and other recreation areas where concessions are located, a person buying several items such as popcorn and a drink also picks up items such as napkins and toothpicks and it is difficult to carry all items in one hand. Attempts to satisfy such a problem have been made and those which are most acceptable require forming the holders into a box or tray and such holders ofter require use of both hands to avoid spilling or slopping the drink.

It was the intent in developing the present invention to provide an inexpensive, disposable holder which is very convenient to store, to contain several cups and to be carried in one hand, leaving the other hand of the customer free to pay or attend to other functions. It should not require much space when disposed.

The closest approach made by the prior art includes disposable flat cardboard holders which includes multiple openings of one or more size primarily to hold ice cream cones, pop bottles or cups. U.S. Pat. No. 1,469,596 to J. W. Hoodwin discloses one such type of tray and U.S. Pat. No. 1,702,199 to F. A. Cunningham discloses another type of tray. The Cunningham and Hoodwin patents indicate that such a flat tray can also be utilized as a fan. The Cunningham patent has radial serations around the openings which permit flexing of small fingers which tend to grip an item in the holder, a function which is found to be an inconvenience insofar as a holder for any type of drink is concerned. Both of these will flex too much with a drink filled cup. Two additional patents, U.S. Pat. No. 3,142,425 to E. W. Cobb for Cone, Beverage Cup and Similar Article Holder and U.S. Pat. No. 3,128,984 to F. W. Palm on Container Holder and Blank illustrate another approach to the problem of a disposable holder. However, these latter patents disclose holders with a circular hole in which to hold cups and furthermore, both of these patents have appurtenances integrally formed with the flat holder area punched from external portions of cardboard and bent down to form a handle, as in the Cobb patent, or bent upward with terminal hook lugs to enable hanging the holder on a window or the like as shown in the Palm patent. While such items do provide the conveniences of relieving the use's hand for other functions, both constitute a more expensive disposable holder than that proposed by this invention.

Additional prior art patents which show tray-like holders are U.S. Pat. No. 2,556,844 to J. Istwan for Serving Tray and U.S. Pat. No. 2,886,225 to H. W. Clarke on Dish and Tray Combination. These prior art articles have a primary drawback of expense plus the undesired factor of large mass when disposed of, as compared with a flat collapsible holder.

SUMMARY OF THE INVENTION

Accordingly a primary object of the present invention is to provide an integral one-piece disposable sheet material holder made from cardboard or plastics material to hold at least two paper cups; the holder having annular openings with at least three spaced apart projections extending radially inward from the periphery of the openings. A further object resides in providing partially cut areas where each of the inward projections join the primary body of the sheet material so tha such projections can be removed leaving the intermittent portions between such projections as secondary spaced apart projections to accommodate larger cups.

A still further object resides in providing integral portions of the sheet material, from the area where the holes are formed, to be shaped as depending strips joined together at their bottom ends to provide a depending lateral support structure for cups placed in the holder.

Further objects of this invention reside in providing various scored areas to enable controlled bends in depending strips with lug and notch formations in the lower ends of the strips for interengagement or, alternatively, with contact adhesive on facing surfaces of the lower ends of the strips to provide joinder of the lower ends, the joined strips thus providing a lateral support structure for cups placed in the holder.

Further novel features and other objects of this invention will become apparent from the following detailed description, discussion and the appended claims taken in conjunction with the accompanying drawings.

BRIEF DESCRIPTION OF THE DRAWINGS

Preferred structural embodiments of this invention are disclosed in the accompanying drawings in which.

GENERAL DESCRIPTION

Figure 1:
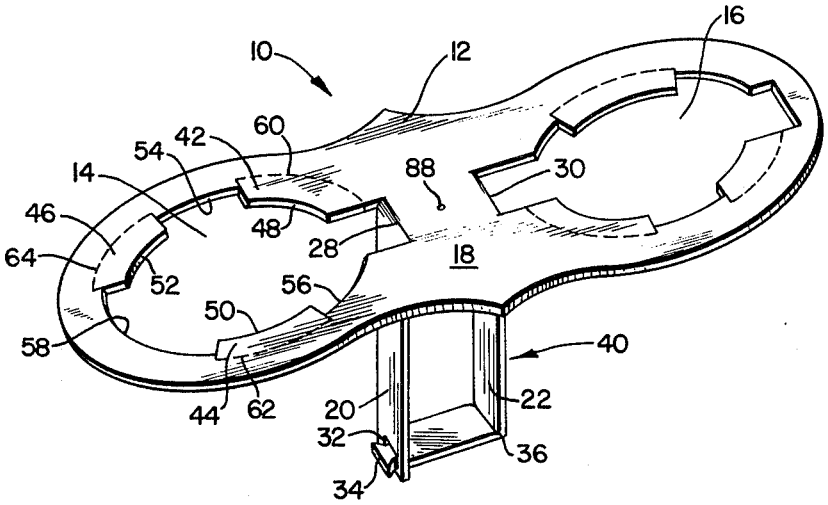
FIG. 1 is a perspective view of the disposable cup holder of this invention in which the depending strips are joined together by a lug and notch formation at their lower ends.
Figure 2:
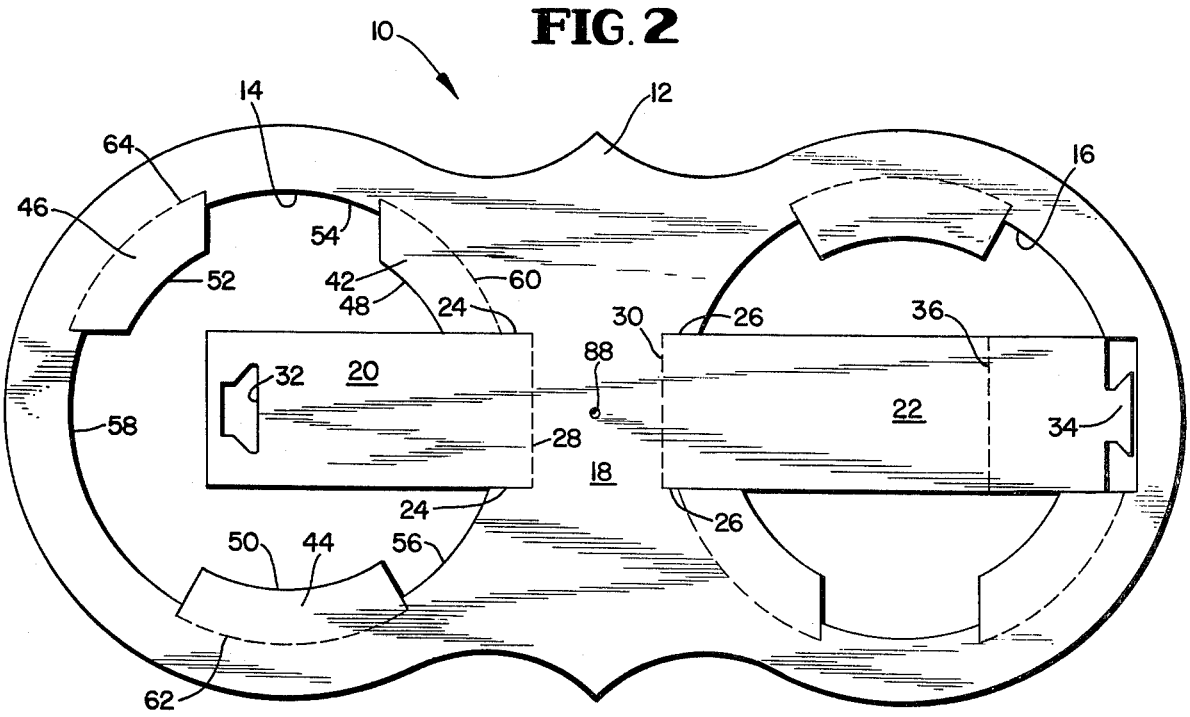
FIG. 2 is a plan view of the cup holder as stamped from flat material in a one stage production cycle, the strips which form the depending support structure being shown in flat position within the area of the cup openings.

FIG. 1 illustrates a preferred form of the paper cup holder 10, the holder being in an assembled condition. FIG. 2 shows the approximate shape of the flat cardboard sheet from which the cup holder is made, it being contemplated that a suitable length can be 20 centimeters, with a width approximately 10 centimeters and a thickness approximating 2–3 mm. If the material is stamped from plastic the thickness can be slightly less but whether made from heavy cardboard such as a double or triple laminated cardboard substance or from plastic there will be a slight flexing when used. Therefore it is preferred that the cup holder include a depending central structure to provide lateral support against the side of a cup as will be more full described hereinafter.

Cup holder 10 is made from flat sheet material such as previously described. As seen in FIG. 2 holder 10 is designed for mass production by single stage stamping or cutting from large sheets of cardboard with minimum waste. Cup holder 10 is an elongate flat body 12 which contains two primary cutout openings 14 and 16 with a central rib member 18 in between. During the production stage two strips of the material are left within the area of openings 14 and 16. Shown in FIG. 2, the left hand strip 20 is shorter than the right hand strip 22 for a purpose to be described. The adjacent ends of each of strips 20 and 22 are integral with the central rib 18, extending into the rib area a slight distance as evidenced by the short through cuts 24 and 26 which extend approximately 3 mm toward each other. The joinder of the two strips to the rib are at bend lines 28 and 30 provided by slight scoring of the upper surface.

Holders 10 are shipped and stored in flat condition, and when used, the two strips are bent downwardly to depend from the center of flat body area 12. At the terminal end of strip 20 a notch shaped cut out 32 is located. The terminal end of strip 22 is cut in the shape of a dovetail lug 34 to interlock with cutout 22. Spaced from the lug end 34 is another lateral scored bend line 36 enabling lug end 34 to be bent toward the opposite strip 20 so the dovetail lug 34 can be slipped into the notch 32. Being just slightly larger than notch 32, the lug 34 will be retained therein and provide the depending support 40 as shown in FIG. 1.

Shown in FIGS. 1 and 2 the cup openings 14 and 16 are provided with inwardly directed projections, the terminal edges of which provide a discontinous circular periphery. Such projections can be provided in one or both openings, however only those for the left hand opening in FIG. 2 will be now described. Opening 14 includes projections or lugs 42, 44 and 46 which are spaced apart equiangularly around the periphery of opening 14 so the circular arc edge portions 48, 50 and 52 of the respective lugs will provide a triple supporting engagement with a cup placed in the opening, yet have minimal contact between the cup and the sheet material. The purpose of the arrangement is to minimize frictional engagement between the cup and holder and the cup enabling ease of removal by the user. The diameter of the circular arcs 48, 50 and 52 will be predetermined to accommodate either a small or medium size cup. To enable use of a larger size cup the arcuate portions 54, 56 and 58 disposed intermediate the three lugs 42, 44 and 46 are cut on a larger circular diameter, and to use the large diameter opening the portion of the lugs 42, 44 and 46 where they are attached to the sheet material body 12 are scored along the dotted line 60, 62 and 64. The scored lines 60, 62 and 64 are made radially outward from the circumference of circular arcs 54, 56 and 58 and can be made relatively deep in just one surface of the table area 14 or can be provided as shallower cuts in both the upper and lower surfaces. Such scoring permits the lugs 42, 44 and 46 to be completely removed by merely bending the lugs once or twice thereby enabling a larger cup to be placed in the opening and the larger diameter opening would still only engage selected portions of the cup to permit ease of removal.

Figure 3:
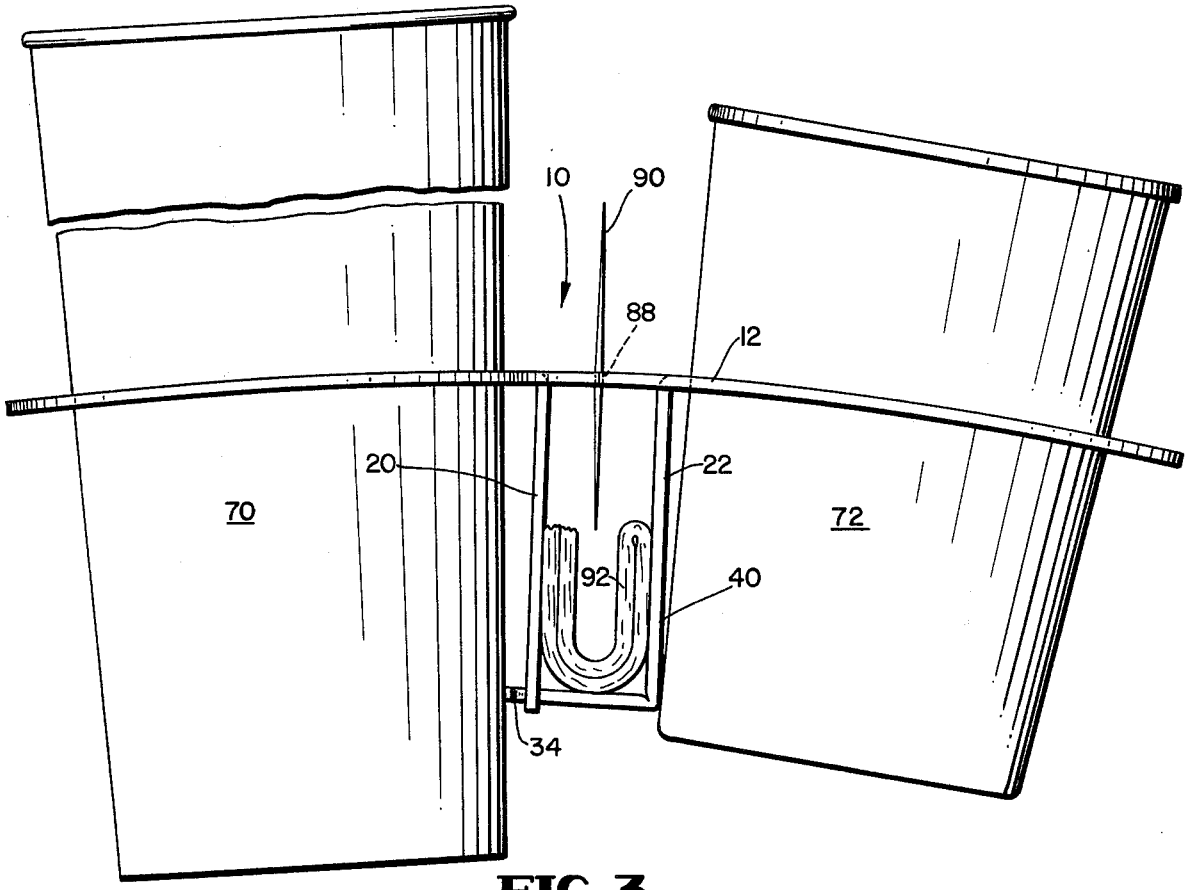
FIG. 3 is a lateral side view of the assembled holder shown in FIG. 1 and further illustrating a large size popcorn cup and a drink cup placed in the holder.

FIG. 3 illustrates a paper cup holder which contains a large type popcorn cup 70 and a smaller sized drink cup 72. The lower portion of the popcorn cup 70 which extends down through the opening is used by the customer to hold the assembled holder and cups. The weight of drink cup 72 will cause a deflection of the table. Therefore it is desirable to provide the depending support structure 40 against which the side of the drink cup will rest to help rigidify and stabilize downward flexing of the cup table.

Figure 4:
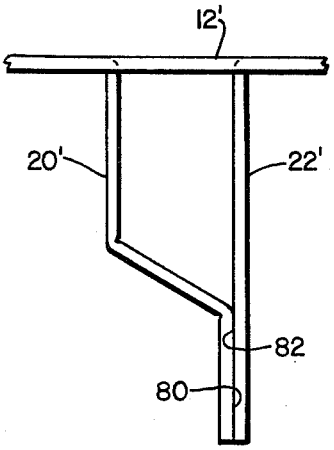
FIG. 4 illustrates a further embodiment of the depending support strips in which the terminal surfaces are pressed together and held by contact adhesive bond.

Shown in FIG. 4 is a second embodiment for enabling joinder of the depending strips. In this embodiment, the table 12' of the cup holder is only partially disclosed and the two depending strips 20' and 22' are shown with their lower facing surfaces pinched into abutment with each other. To cause the two surfaces to remain engaged a thin layer of contact adhesive 80, 82 can be placed on approximately 1 inch of the facing lower surfaces of the two strips 20' and 22'. When the flat cup holder is picked up by the person who dispenses the items, that person only has to use a thumb and one of their fingers to bend the strips down through the two openings and press the bottom portions of strips 20' and 22' together. When the contact adhesive layers are pressed together, adhesive bonding occurs and the lower portion of the support structure 40' is secured together. It is noted that one strip 22' is essentially vertical whereas the other strip 20' has several bend formations in the engaged condition. The proper bending of strip 20' can be caused by providing light horizontal bend line scores in that strip. It is preferred that the strip 22' adjacent the opening that holds the drink be essentially vertical to minimize flexing of the table portion.

Figure 5:
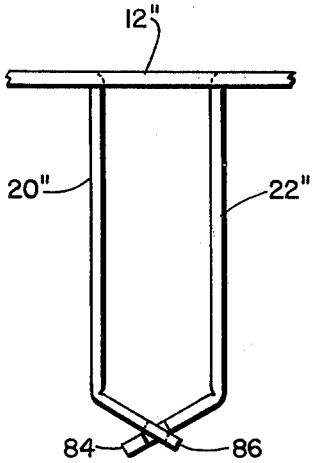
FIGS. 5 and 6 illustrate another embodiment of lug and notch terminal end engagement elements on depending support strips.
Figure 6:
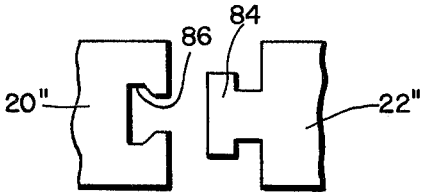

FIGS. 5 and 6 illustrate a further embodiment of lug and notch means 84 and 86 by which the lower ends of the depending strips 20'' and 22'' can be retained in secure position, in a manner which is self evident. Other shapes for interlocking lugs and/or notches are well-known in the cardboard container art.

Several auxiliary features of the present invention are provisions of a small hole 88 pierced in the central portion of rib 18 into which the user can insert a toothpick 90 for use as desired. A further advantage of the present invention is that the depending support structure 40 has an open space into which a napkin 92 can be stuffed. If desired the holder can be made with somewhat larger dimensions, for example, it can be made longer so the central rib can be wider, thereby resulting in a somewhat larger depending support structure, and the enlarged width of the opening in that depending support could be used to hold a hot dog.

This paper cup holder enables a person to hold popcorn and a drink together with a toothpick and a napkin all in one hand. An advantage, besides having a free hand to provide other functions such as paying the bill, etc., is that the hand is not placed on a cold drink cup, because the popcorn cup is used as a handle. Therefore no body heat is transferred to the cold drink, and its "cold life" is increased. The discontinuous edge formation of the cup holes enables the drink to be easily lifted from the holder and replaced at the discretion of the user, without inadvertent spillage. The holder is a throw-away item which can be produced in an array of colors creating the possibility of afterlife by children for use such as mobiles, toys, etc. It also provides space for specialty advertising. The flat material cup holder is less costly than box type holders which require assembly and take up the dispenser's time, take up more room in storage and more space when placed in a trash container.

The invention may be embodied in other specific forms without departing from the spirit or characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. An integral one piece disposable holder for paper cups and the like comprising: a sheet of inexpensive disposable material, said sheet having at least two openings, each being shaped to hold a cup, a lateral rib between said openings, two elongate strips of material each having one of its ends integral with an opposed edge of said rib and adapted to depend from the portion of the periphery of an associated opening formed by said rib, means enabling portions of said two strips of material adjacent their other ends to be secured directly to each other to thereby constitute a depending central means to provide lateral support for cups placed within said openings.

2. A disposable holder as defined in claim 1, wherein the joinder of said strips to said rib is scored along a straight line to provide a deliberate bend line.

3. A disposable holder as defined in claim 1, wherein the means enabling the other end portions of said strips to be secured to each other is a lug formation on one strip and a notch formation on the other strip, the lug and notch formations being interlockable.

4. A disposable holder as defined in claim 1, wherein the means enabling the other end portions of said strips to be secured to each other is a layer of contact adhesive material on facing surfaces of said depending strips.

5. A disposable holder as defined in claim 1, wherein the periphery of at least one of said openings has at least three radially inwardly projected lug means circumferentially spaced apart around the periphery of the opening to provide discontinous annular cup engaging means.

6. A disposable holder as defined in claim 5, wherein said lug means have arcuate edges of a least about 15°, and the sheet material where the lug means are joined is scored to enable removal of all said lug means to thereby enable the periphery portions around the opening which remained between the lug means to serve as spaced apart radially inwardly disposed secondary lug means enabling reception of larger cups.

7. A disposable holder as defined in claim 6, wherein both openings include said lug means.

8. A disposable holder as defined in claim 5, wherein both openings include said lug means.

9. A disposable holder as defined in claim 1, wherein a small hole is provided through said sheet to enable reception of a toothpick.

10. A disposable holder as defined in claim 9, wherein said small hole is provided centrally through said rib.

11. A disposable holder as defined in claim 1, wherein said sheet is made from stiff cardboard, at least double laminate and at least approximately 3/22 inch (2 mm.) in thickness.

12. A disposable holder as defined in claim 1, wherein said sheet is made from plastics material.

13. An integral one piece disposable holder for paper cups and the like consisting of a sheet of inexpensive disposable material, said sheet having at least two openings, each being shaped to hold a cup, a lateral rib means between said openings, the periphery of at least one of said openings having at least three radially inwardly projected lug means circumferentially spaced apart around the periphery of the opening to provide discontinous annular cup engaging means, and portions of said sheet material derived from material within each of the openings depend from and are structurally integrally joined to said lateral rib means, said portions providing a depending hand hold support.

* * * * *